United States Patent [19]

Guala

[11] Patent Number: 4,494,664

[45] Date of Patent: Jan. 22, 1985

[54] TAMPER EVIDENT CLOSURE

[75] Inventor: Piergiacomo Guala, Alessandria, Italy

[73] Assignee: Angelo Guala, S.p.A., Alessandria, Italy

[21] Appl. No.: 470,535

[22] Filed: Feb. 28, 1983

[30] Foreign Application Priority Data

Mar. 9, 1982 [IT] Italy ..... 20041 A/82

[51] Int. Cl.[3] ..... B65D 41/34

[52] U.S. Cl. ..... 215/252; 215/258

[58] Field of Search ..... 215/252, 258, 253

[56] References Cited

U.S. PATENT DOCUMENTS

| | | | |
|---|---|---|---|
| 2,162,754 | 6/1939 | Schauer | 215/252 |
| 3,232,470 | 2/1966 | Gibson . | |
| 3,314,564 | 4/1967 | Andersen et al. | 215/252 |
| 3,335,889 | 8/1967 | Brumme . | |
| 3,904,062 | 9/1975 | Grussen | 215/252 |
| 3,957,169 | 5/1976 | Coursaut | 215/253 |
| 4,225,050 | 9/1980 | Reinhart | 215/252 |
| 4,322,009 | 3/1982 | Mumford | 215/253 |
| 4,343,408 | 8/1982 | Csaszar | 215/252 X |

FOREIGN PATENT DOCUMENTS

| | | |
|---|---|---|
| 1536459 | 7/1968 | France . |
| 974564 | 11/1964 | United Kingdom . |
| 2076381 | 12/1981 | United Kingdom . |

*Primary Examiner*—Donald F. Norton

*Attorney, Agent, or Firm*—Brumbaugh, Graves, Donohue & Raymond

[57] ABSTRACT

A tamper evident closure for bottles and containers includes a cap and a tamper-indicating lower ring or belt, those two parts are linked together by a weak breakable circumferential area, which will break at opening of the container leaving behind the lower ring. This closure is the result of a simplified manufacturing process that forms the breakable circumferential area by forming misaligned cuts about the circumference of the closure between the upper cap and lower ring. Upon opening, the lower ring moves down on the neck of the container. Upon reclosing, the space between the cap and ring makes the prior opening of the bottle very evident.

20 Claims, 12 Drawing Figures

TAMPER EVIDENT CLOSURE

BACKGROUND OF THE INVENTION

The present invention relates to a tamper evident closure for bottles and containers in general and more particularly to a closure having a cap and a tamper indicating lower ring or belt, these two parts being linked together by a weak breakable circumferential area that will break at opening of the container.

In bottling and packaging foods, drugs, and household products, which are currently sold in the market place by the millions of containers, it is necessary to use closures that are efficient and economical at the same time. Tamper evident closures satisfying these requirements are needed. These closures must be structurally simple and must make evident the fact that the container was opened.

In certain currently available tamper evident closures, there are a number of problems with relation to a weakened area that is obtained by means of a linkage between the cap and the lower ring. These closures use a number of vertical bridges that break at the time of opening. The bridges are separated by circumferentially extending slots. If made easy to break at removal, these bridges will also easily break at the capping of the container. On the bottling or packaging line, this creates problems and stoppages. Of course, if the bridges are made stronger, the cap becomes hard to remove. To avoid breaking of the bridges during capping, one proposal has been to use, in the weakened area, one or more pushing teeth or ratchet teeth in the shape of saw-teeth. These are oriented in a way that, at the time of applying the closure by screwing it onto the container neck, the tooth or teeth apply turning torque from the cap to the ring. The cap pushes with it the lower ring and without stress on the bridges. See the expired French Pat. No. 1,536,459. These closures are not only difficult to manufacture, but they are also very expensive, given the complexity of the molds required for their formation.

BRIEF SUMMARY OF THE INVENTION

The foregoing problems have been solved by the tamper evident closure according to this invention, having the characteristic that a circumferential weakened area is made by nonaligned limited circumferential cuts about the closure between the upper cap and the ring. The cuts can be misaligned by virtue of their being on two closely spaced circumferential circles.

The nonaligned cuts that form the weakened area about the closure do not intersect, but define between them unsevered portions. The cuts are not slots of the nature of the prior closures described above. The upper edge of the cut is not spaced from the lower edge so as to leave an open space between. The cuts or slits of the current invention have contiguous upper and lower edges. Torque applied to the cap in closing is transmitted to the ring both by the unsevered portions of the closure in the weakened area and by frictional engagement of the upper and lower edges of the cuts.

In one preferred embodiment, ratchet-like teeth on the inside of the ring engage ratchet-like teeth on the neck of the container. These allow the ring to turn in the direction in which the closure is screwed onto the container, but prevent turning of the ring in the unscrewing direction.

A lip or boss about the container neck prevents the ring moving upward with the cap when the cap is removed. When the unsevered portions in the weakened area break, they form camming surfaces that cam the ring portion of the closure down and an inward projection thereon over the lip or boss. A distinctly visible space is defined between the ring and the cap when the cap is screwed back into place on the container. That the container has previously been opened is clearly evident.

Because of the misalignment of the cuts in the weakened area, an inherent and integral gear tooth type of torque communication exists between cap and ring. The closure is extremely resistant to separating upon tightening the cap into place, and yet the ring breaks away surprisingly easily when the cap is unscrewed.

As for the process of making the closure, the cuts are easily accomplished after the closures are molded, and complex injection molds are unnecessary.

The accomplishment of foregoing and further objects and advantages of the invention will be better understood from the following detailed description of preferred embodiments made with respect to the several figures of the accompanying drawing.

DESCRIPTION OF PREFERRED EMBODIMENTS

Figure 1:
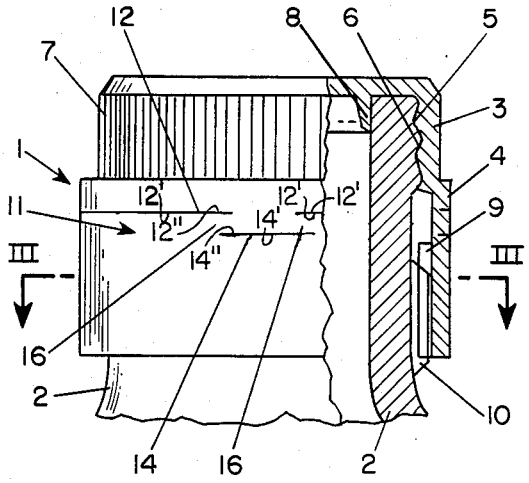
FIG. 1 is a fragmentary elevational view of a closure and container according to the invention and having an upper cap separated from a lower ring by a weakened area.

In FIG. 1, the closure 1 includes an upper cap 3 and a lower ring 4. The cap 3 has an inner thread 5 with one or more beginnings or starts for easy application to a container neck. The threads 5 engage a set of threads 6 on a neck 2 of a container. For ease of removal, the cap 3 has a ribbed area 7. Inside the upper surface of the cap, a conventional sealing ring 8 engages the container neck 2.

Figure 3:
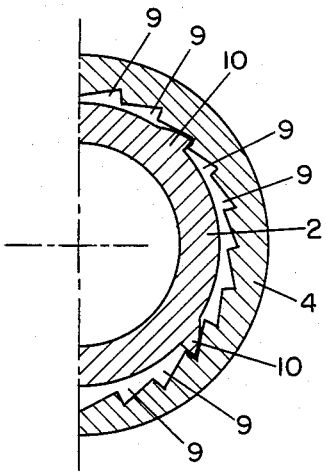
FIG. 3 is a partial sectional view along the lines 3—3 of FIG. 1 and illustrates interengaging teeth on the closure and container preventing ring movement in the cap-unscrewing direction.

Inside, the ring portion 4 of the closure has a sequence of teeth 9, of a saw-tooth profile, and engaging corresponding teeth 10 on the neck 2, as best seen in FIG. 3. The teeth 9 and 10 are thus oriented such that they will engage at the time of applying the closure 1 to the container neck 2. Thus it can be seen, the interengaging teeth 9 will permit movement of the ring 4 in the direction in which the cap is screwed onto the neck, but will resist movement of the ring in the cap-unscrewing direction.

Figure 2:
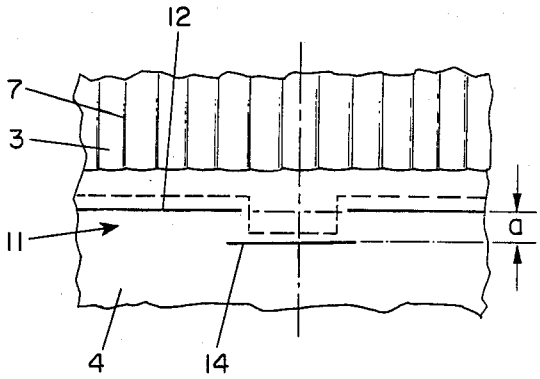
FIG. 2 is an enlarged fragmentary plan view of the relationship of cuts in the weakened area in the closure of FIG. 1.

Between the cap 3 and the ring 4, a weakened area 11 is defined. This is made by circumferential cuts 12 along a circumference 13, as shown in FIG. 2, and circumferential cuts 14 along a circumference 15 in that Figure. The cuts 12 and 14 are alternated in the circumferential direction about the weakened area 11. The two circumferences 13 and 15 are close, so that the end of the cuts 12 and 14 are close, as well. The distance between the circumferences in the axial direction, and between the cut ends in that direction, is a, about 1 mm.

In the example according to FIG. 1 there are two cuts 12 diametrically opposed. These have the length of about 150° each. There are two cuts 14, also diametrically opposed, having a length of about 40° each. The cuts 12 and 14 have ends that are partially overlapping. The cuts have contiguous upper and lower edges in the form of engaging upper and lower cut surfaces. The upper surface of the cut 12 is designated 12' and the lower surface 12". The upper surface of the cut 14 is designated 14' and the lower surface 14". Bridges or unsevered portions 16 (FIG. 1) are formed between the cuts. The closure is molded with the cap 3 and ring 4 as one piece preferably by injection molding of a plastic, for example polypropylene, using simple molds with high productivity. The weakened area 11 is produced by cutting the cuts or slits 12 and 14 with rotating blades in a subsequent simple and efficient operation.

Applying the closure 1 on the neck 2 requires only screwing the thread 5 of the cap onto the corresponding thread 6 of the neck of the container. While screwing the cap on, the cap forces with it in rotation the ring 4. In this direction the teeth 9 and 10 of FIG. 3 slide one over the other in the manner of a ratchet. The axial force, that is to say downward force of the cap 3 on the ring 4 in the weakened area, is a compressive force that does not tend to break the bridges or unsevered portion 16. It will also be seen that the cuts in the weakened portion define an integral and inherent gear tooth type of arrangement as indicated by the dotted lines in FIG. 2. Thus downward axial force in combination with the torque applied in screwing the cap into place causes the inherent and integral gear teeth not to tend to slip apart and tearing of the bridges or unsevered portions does not occur.

Figure 4:
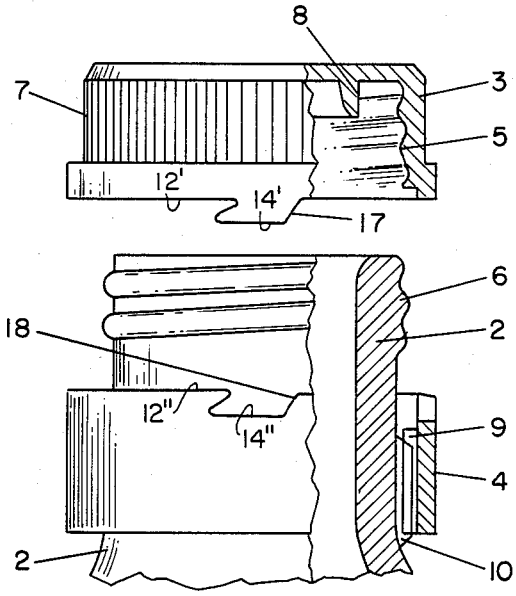
FIG. 4 is a fragmentary exploded view of a closure like that of FIG. 1 with the upper cap portion broken away from the retained ring.

When the container is opened, however, the interengaging ratchet teeth 9 and 10 of the ring and container neck prevent return rotation of the ring. The unsevered portions 16 of the weakened area break to define a separate cap and ring as illustrated in FIG. 4. Breaking apart of the cap and ring defines cam profiles 17 and 18 on the cap and ring, respectively. These act to push down the ring for a distance approximately equal to the distance a. When the cap 3 is screwed back on the neck 2 of the container, there remains a permanent gap quite visible and at least approximately equal to the distance a. This gap clearly indicates that the container has been tampered with or opened.

Figure 5:
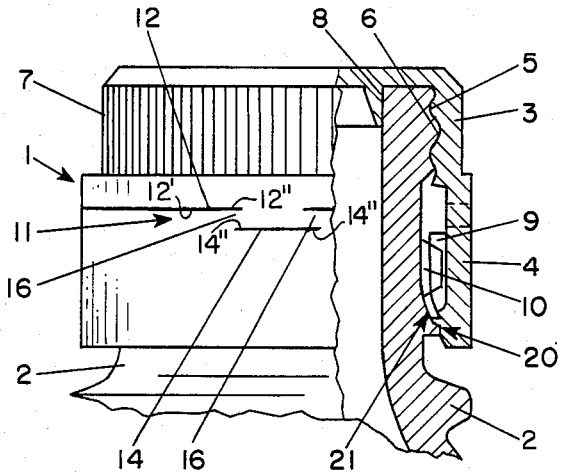
FIG. 5 is a fragmentary elevational view of a further embodiment of the invention and illustrates interacting means on the container and the ring portion preventing upward movement of the ring.
Figure 6:
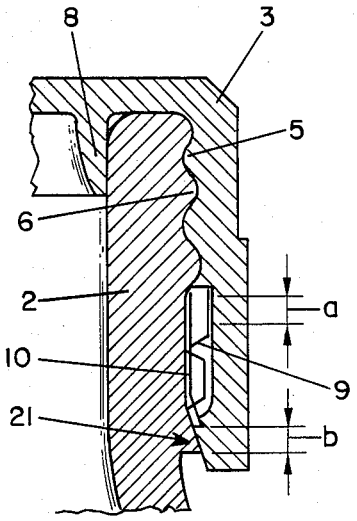
FIG. 6 is an enlarged fragmentary cross-sectional view of a closure like that of FIG. 5 and more clearly illustrates the relationship of the parts retaining the ring on the neck of a container.
Figure 7:
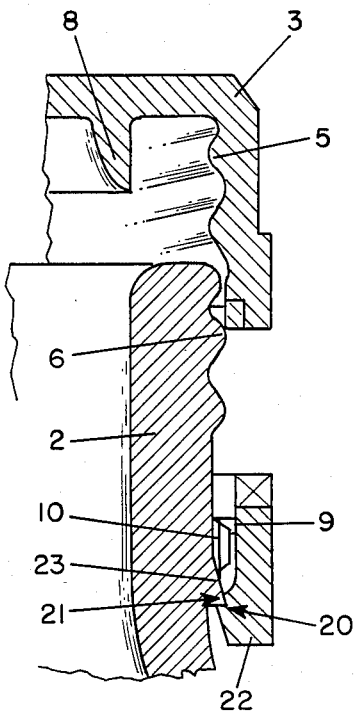
FIG. 7 is an enlarged, exploded fragmentary cross-sectional view of a closure like that of FIG. 5, illustrating the cap portion of the closure broken away and removed and the ring retained on the container.

Referring to FIGS. 5, 6 and 7, like numerals are applied to like elements, but a circular projection or boss projects inwardly about the interior of the ring 4 in engagement with a further circular projection or boss projecting outwardly about the neck 2 of the container. As is apparent from FIGS. 6 and 7, the two projections 20 and 21 are formed with a saw-tooth or latching profile. Longer gradually inclined outer surfaces or profiles 22 and 23 permit the projections to pass one another when the ring is driven downward. Shorter, more horizontal surfaces facing downward on the container neck projection and upward on the ring projection inhibit movement of the ring upward and off of the container neck. When the closure is applied, the two saw-tooth profile projections overlap by a length b shorter than the length a, for example about 0.75 millimeters. When the closure is opened, the cam surfaces 17 and 18 described above push down the ring 4 a distance a. So it will be seen that the inward projection 20 latches under the projection 21, inhibiting upward movement of the ring. If desired, the latching of the projections like 20 and 21 to prevent upward movement of the ring 4 can be employed to the exclusion of the ratchet teeth that prevent turning of the ring, in which case the unsevered portions in the weakened area will be placed in sufficient tension to cause their breaking when the cap is unscrewed. The ring 4 cannot now be moved vertically upward beyond its new position, and for this reason the gap that is defined between the reapplied cap and the so-located ring cannot be closed. Moreover, the neck of the container can be shaped to continue downward at about the same diameter below its projection 21 before turning outward in a shoulder so that the ring drops to a position of rest even further down on the neck away from the location of the cap. Particularly when the closure and the container are of contrasting colors a container that has been tampered with will stand out quite evidently on the shelf among its fellow, untouched containers.

It should be understood with respect to this and the embodiments that are described below that the container neck provisions, e.g. the threads, projections, and teeth, can be provided, as well, on a separate part applied, for example to the neck of a bottle. Such a separate part might be, for example, a pourer or other bottle or container neck feature.

Figure 8:
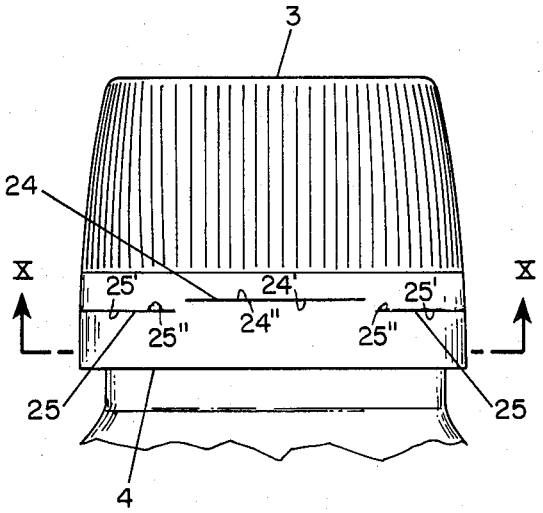
FIG. 8 is a plan view of a further embodiment of a closure according to the invention in which the cuts that weaken the area between the cap and the ring do not overlap.
Figure 9:
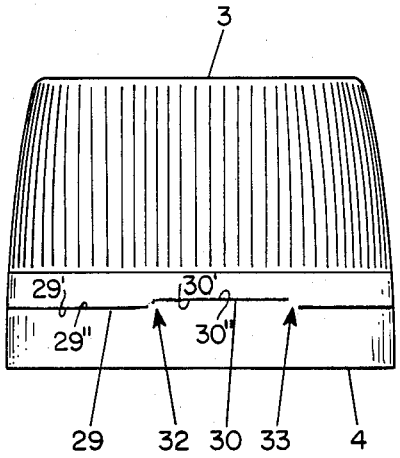
FIG. 9 is a plan view of another embodiment of the invention in which at one end each cut is closer an adjoining cut than at its other end.
Figure 12:
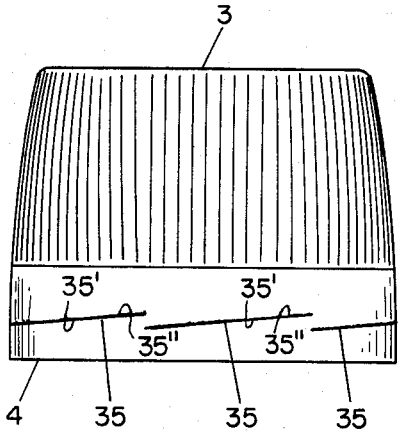
FIG. 12 is a plan view of yet another embodiment of the invention wherein the cuts in the weakened area are inclined to cause the misalignment.

In FIG. 8, a further embodiment of the invention is seen wherein cuts or slits 24 and 25 in the weakened area between the ring 4 and the cap 3 do not overlap. Again, as shown, the upper and lower surfaces 24', 24" and 25', 25" formed in the cuts are not spaced apart, but form contignous edges. In FIG. 9, cuts 29 and 30 are closer at one end 32 then at the other end 33, so that it is a bridge or unsevered portion at the ends 33 that initially holds the ring 4 and cap 3 together and determines the small torque or twisting force necessary to break the cap away from the ring. The cuts' upper and lower surfaces 29', 29" and 30', 30" contact. In FIG. 12, a further arrangement of the cuts are seen in which the cuts are mis-aligned at their adjoining ends by virtue of the cuts 35 being inclined slightly from the horizontal. Contiguous cut edges are again formed by unspaced and upper and lower surfaces 35' and 35".

Figure 10:
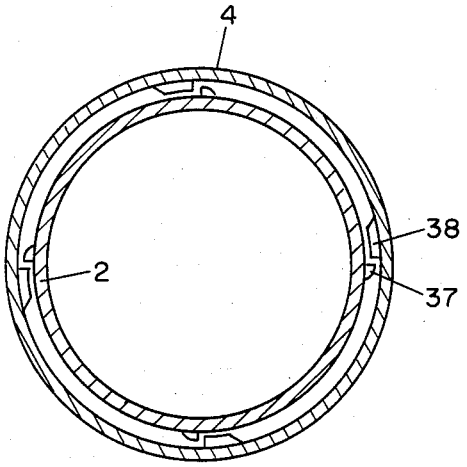
FIG. 10 is a cross-section view along the line 10—10 of FIG. 8 and shows a closure and container neck including another embodiment of the teeth that prevent turning of the ring in the cap-unscrewing direction.
Figure 11:
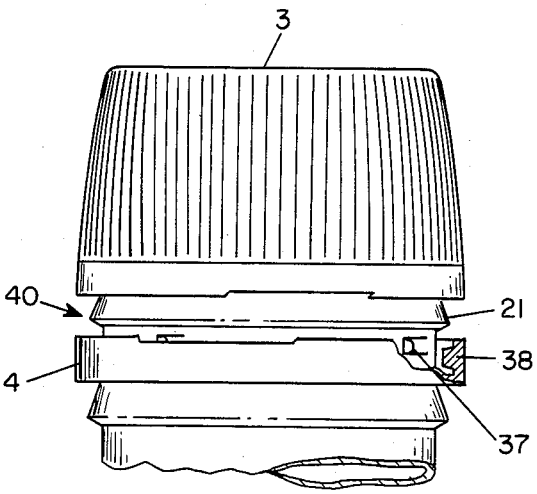
FIG. 11 is fragmentary plan view of a closure like that of FIG. 8 illustrating the appearance of the closure upon reapplication of the cap.

Regardless of the arrangement of the cuts, the teeth interacting between the container neck and the ring can be as illustrated in FIG. 10, wherein at about every 90° around the neck 2 and ring 4, the teeth 37 and 38 occur on the neck and ring respectively. The teeth 38 inwardly projecting from the ring can serve the purpose of the inward projecting boss 22 of FIGS. 5, 6 and 7, as well. In FIG. 11, one of the inwardly projecting teeth 38 can be seen to extend inwardly beneath the boss or circular projection 21 on the container neck to inhibit movement of the ring 4 upward.

FIG. 11 also serves to illustrate the previous opening or tampering with the container clearly evident in the gap 40 between the ring 4 and the cap 3.

Whereas preferred embodiments of the invention have been described above, it will be apparent to those skilled in the art that certain modifications may be made without departure from the spirit and scope of the invention contained therein, the scope of the invention being as set forth in the appended claims.

I claim:

1. A tamper evident closure and container combination including a closure having an upper cap portion, a lower ring portion, and an intermediate weakened area, the weakened area being defined by nonaligned cuts separated by unsevered locations, the combination further comprising interacting means on the ring and container for blocking movement of the ring in a closure opening direction, the interacting means for blocking movement comprising inwardly projecting means on the ring and outwardly projecting means on the container, the inwardly and outwardly projecting means being axially located to be in abutting relationship when the closure is in place on the container, the cuts and unsevered locations defining cam surfaces upon separation of the cap and ring effective to cam the ring downward until the inwardly projecting means on the ring is below the outwardly projecting means on the container; whereby the ring and cap separate the weakened area to leave behind the ring and, the ring is held captive on the container at a lower location than its previous, unseparated position.

2. The combination according to claim 1 wherein the interacting means for blocking movement comprises means on the container in interference relation to a part of the ring and preventing upward movement of the ring.

3. The combination according to claim 2 wherein the means on the container in interference relation comprises an outwardly projecting boss interfering with upward movement of the ring.

4. The combination according to claim 2 wherein the cap and container are threaded to screw the closure in place and the interacting means comprises means for preventing rotational movement in the cap-unscrewing direction; whereby both upward and rotational movement of the ring is blocked when the cap is unscrewed.

5. The combination according to claim 1 wherein the cap and container are threaded to screw the closure in place and the interacting means comprises means for preventing rotational movement of the ring in the cap-unscrewing direction.

6. The combination according to claim 1 wherein the cuts are defined with engaging upper and lower surfaces and absent spacing between those surfaces.

7. The combination according to claim 1 wherein the cuts are defined on two axially displaced circumferences.

8. The combination according to claim 7 wherein each cut is closer to another cut at one of its ends than at the other of its ends.

9. The combination according to claim 1 wherein the neck of the container below the outwardly projecting means has a diameter allowing the ring to drop further downward on the container away from its previous, unseparated position.

10. A tamper evident closure comprising an upper cap portion, a lower ring portion, and an intermediate weakened circumferential area interconnecting the cap and ring, said weakened area having nonaligned cuts proceeding generally circumferentially about the closure and defining therebetween unsevered areas, the cuts and unsevered areas in the weakened area defining cam surfaces upon separation of the cap and ring effective to cam the ring downward away from the cap.

11. The closure according to claim 10 further comprising removal inhibiting means on the ring.

12. The closure according to claim 11 wherein the removal inhibiting means on the ring comprises inwardly projecting means within the ring for inhibiting upward movement of the ring upon removal of the cap from a container.

13. The closure according to claim 11 wherein the cap is internally threaded to be screwed in place upon a container, the removal inhibiting means within the ring comprising inwardly projecting means for inhibiting turning of the ring in the cap unscrewing direction.

14. The closure according to claim 13 wherein the means for inhibiting turning of the ring in the cap unscrewing direction comprises inwardly projecting ratchet teeth for permitting turning in the closure applying direction and prohibiting rotation of the ring in the cap unscrewing direction.

15. The closure according to claim 14 wherein the teeth also are dimensioned to protrude inward below an outward protruding container portion to define means inhibiting upward movement of the ring.

16. The closure according to claim 10 wherein the cuts are defined with engaging upper and lower surfaces and absent space between those surfaces.

17. The closure according to claim 10 wherein the cuts are defined on two axially displaced circumferences.

18. The closure according to claim 10 wherein each cut is closer to another cut at one of its ends than at the other of its ends.

19. The closure according to claim 10 wherein the ends of the cuts are misaligned where they are closest.

20. The closure according to claim 10 wherein the cuts are inclined from the horizontal to bring their ends out of alignment.

* * * * *